United States Patent [19]

Imaeda

[11] Patent Number: 4,967,704

[45] Date of Patent: Nov. 6, 1990

[54] AIR INTAKE DEVICE FOR ENGINE OF MARINE PROPULSION BOAT

[75] Inventor: Hirofumi Imaeda, Hamamatsu, Japan

[73] Assignee: Sanshin Kogyo Kabushiki Kaisha, Hamamatsu, Japan

[21] Appl. No.: 357,476

[22] Filed: May 26, 1989

[30] Foreign Application Priority Data

Jun. 3, 1988 [JP] Japan ..... 63-136867

[51] Int. Cl.[5] ..... F02M 35/10

[52] U.S. Cl. ..... 123/52 MV; 123/73 A

[58] Field of Search ..... 123/73 V, 73 R, 52 M, 123/52 MV, 52 MC, 73 A, 52 MB

[56] References Cited

U.S. PATENT DOCUMENTS

| | | | |
|---|---|---|---|
| 2,869,527 | 1/1959 | Groves | 123/52 MV |
| 3,520,284 | 7/1970 | Ruoff et al. | 123/52 MV |
| 4,261,305 | 4/1981 | Ikoma | 123/73 AD |
| 4,266,514 | 5/1981 | Tyner | 123/73 R |
| 4,463,711 | 8/1984 | Yoshioka | 123/52 MV |
| 4,474,144 | 10/1984 | Tanaka et al. | 123/52 MV |
| 4,702,202 | 10/1987 | Hensel et al. | 123/52 MC |
| 4,773,884 | 9/1988 | Matsumoto | 123/73 AD |

FOREIGN PATENT DOCUMENTS

| | | | |
|---|---|---|---|
| 0045408 | 4/1979 | Japan | 123/73 A |
| 0110845 | 7/1983 | Japan | 123/73 A |
| 0099027 | 6/1984 | Japan | 123/52 MC |
| 63-18179 | 1/1988 | Japan . | |

*Primary Examiner*—David A. Okonsky

*Attorney, Agent, or Firm*—Ernest A. Beutler

[57] ABSTRACT

Two embodments of induction devices for V-type engines wherein a compact configuration is achieved by having the inlet for the induction device disposed between the area defined by the associated induction devices of the engine.

16 Claims, 3 Drawing Sheets

AIR INTAKE DEVICE FOR ENGINE OF MARINE PROPULSION BOAT

BACKGROUND OF THE INVENTION

This invention relates to an air intake device for an engine and more particularly to an improved, compact and yet high capacity air intake device for an engine.

As is well known, an internal combustion engine requires copious amounts of air during its operation. This is particularly true with respect to the induction system for the engine, since as is well known, the output of the engine depends directly upon its ability to induct air. Although the principle is well known, the capability of providing adequate air flow to the engine for high power outputs is a more difficult problem in practice. This is particularly true in conjunction with outboard motors, wherein the overall configuration of the power head should be kept as small and as compact as possible for obvious reasons.

In outboard motors employing V-type engines and operating on the crankcase compression, two-cycle principle, it is a common practice to provide an individual carburetor or carburetor barrel for each crankcase chamber. Frequently, these carburetors are disposed at an angle corrsponding to the angle between the cylinder banks. Normally, the induction system and carburetors are disposed at the forward end of the power head and it is desirable to keep the transverse width of the power head small for streamlining and appearance purposes. However, it is also necessary to provide some form of air intake device for collecting air from within the protective cowling of the outboard motor and delivering it to the induction end of the carburetors. Normally, this form of air intake device also incorporates some form of silencing arrangement in the form of a tuning tube that extends from a plenum chamber that communicates with the inlet end of the carburetor. Frequently, it is the practice to provide these tuning tubes at the outer peripheral edges of the carburetors and extending in a rearwardly facing direction. However, this form of disposition of the intake devices and their inlets substantially increases the width of the forward portion of the engine, an undesirable result.

It is, therefore, a principal object of this invention to provide an improved and compact induction system for an internal combustion engine.

It is a further object of this invention to provide an improved and compact induction system for an engine that has intake devices that are disposed at an angle.

It is a further object of this invention to provide an improved and compact air intake device for a V-type, two-cycle, crankcase compression internal combustion engine and outboard motor employing such an engine.

In addition to the features as aforenoted, it is also desirable that the intake device provide silencing for the inducted air, as aforenoted. In connection with an outboard motor, since the power head is positioned in close proximity to the operator, it is also desirable to insure that the induction system noises are directed away from rather than toward the operator. It is, therefore, a still further object of this invention to provide an improved silencing arrangement for the induction system of an internal combustion engine as used in an outboard motor.

SUMMARY OF THE INVENTION

This invention is adapted to be embodied in an induction system for an engine that is comprised of a pair of angularly disposed induction devices having inlet portions and an air intake means associated with the induction devices and having outlet means communicating with their inlet portions for delivering air thereto. The air intake means includes an air inlet for admitting atmospheric air to the air intake means and which is disposed between the induction devices.

DETAILED DESCRIPTION OF THE PREFERRED EMBODIMENTS

Figure 1:
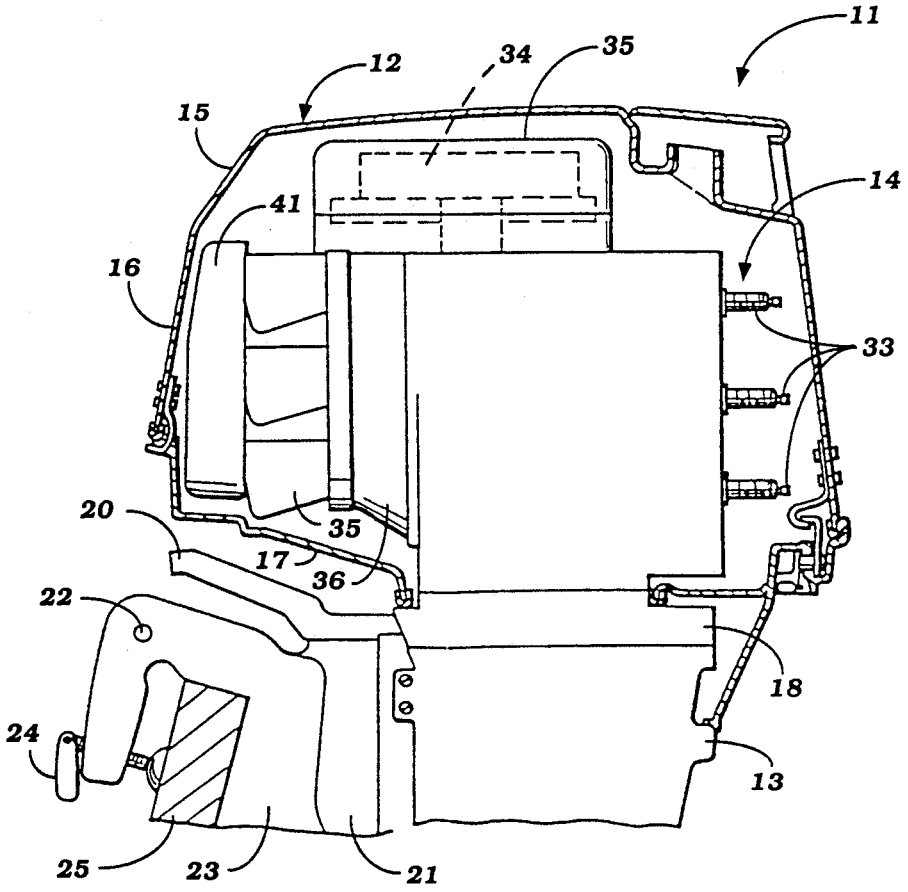
FIG. 1 is a side elevational view of a portion of an outboard motor constructed in accordance with an embodiment of the invention as attached to the transom of an associated watercraft, with portions broken away and other portions shown in section.
Figure 2:
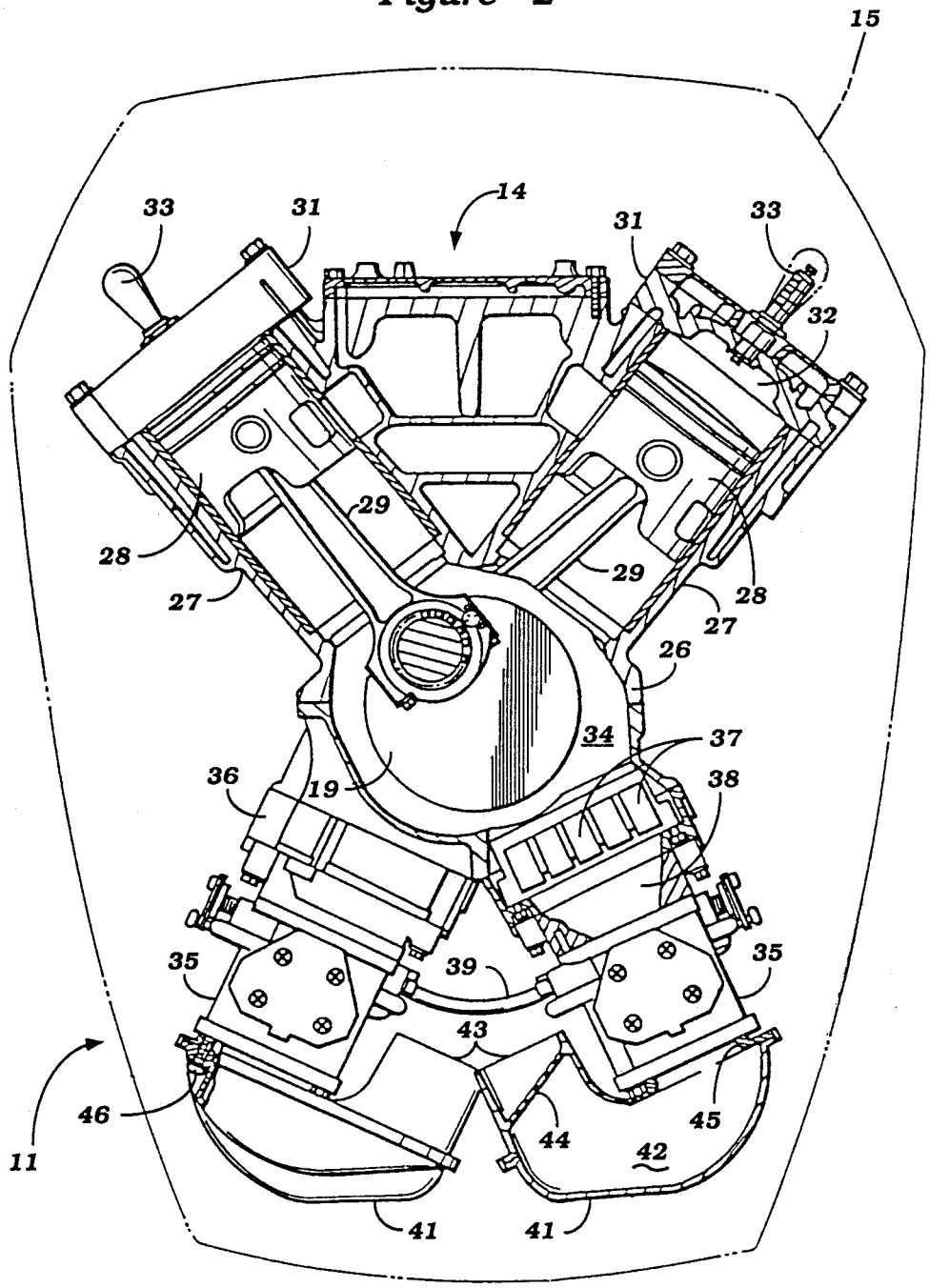
FIG. 2 is a top plan view of the power head of the outboard motor on an enlarged scale and with portions broken away and shown in section and other portions shown in phantom.

Referring first to the embodiment of FIG. 1 and 2, an outboard motor constructed in accordance with this embodment is shown partially and is identified generally by the reference numeral 11. The invention is described in conjunction with an outboard motor because it has particularly utility in connection with such applications due to their requirement for a compact and streamlined configuration. However, it is to be understood that certain facets of the invention may be utilized in conjunction with other applications. Since the invention relates to the construction of the induction system for the outboard motor 11, only the power head, indicated generally by the reference numeral 12 and upper portion of the drive shaft housing, indicated by the reference numeral 13, have been depicted.

The power head 12 includes a powering internal combustion engine 14 which, in the illustrated embodiment, is depicted as being of the V6, crankcase compression, two-cycle type. The invention has particular utility with V-type, crankcase compression engines but the invention may be practiced in connection with other types of engines. A protective cowling 15 encircles the engine 14 and consists of an upper or main portion 16 and a lower tray 17. The tray 17 is sealingly engaged with a spacer plate 18 with the engine 14 being supported on the upper side of the spacer plate 18.

The engine 14 drives a crankshaft 19 that rotates about a generally vertically extending axis and which drives a drive shaft (not shown) that is journaled in a known manner within the drive shaft housing 13. The lower end of this drive shaft drives a propulsion device which is not shown since, as has been noted, that portion of the construction forms no part of the invention.

A steering shaft (not shown) to which a steering tiller 20 is affixed is connected to the drive shaft housing 13 and is supported for steering movement within a swivel bracket 21. The swivel bracket 21 is, in turn, pivotally connected by a pivot pin 22 to a clamping bracket 23 for tilt an trim movement of the outboard motor 11 about a horizontally disposed axis. The clamping bracket 23 carries a clamping device 24 so as to affix the outboard motor to a transom 25 of an associated watercraft in a known manner.

Referring now primarily to FIG. 2, it will be seen that the engine 14 is comprised of a cylinder block 26 that has a pair of angularly disposed cylinder banks 27. Cylinder bores are formed in the cylinder banks 27 and slidably support respective pistons 28. The pistons 28 are connected by means of connecting rods 29 to the crankshaft 19 for driving it.

Cylinder heads 31 are affixed to the cylinder banks 27 and form combustion chambers 32 with the pistons 28 and cylinder bores in a known manner. Spark plugs 33 are provided in the cylinder heads 31 and communicate with the combustion chambers 32 for firing the charge therein. The spark plugs 33 are fired in a known manner from a flywheel magneto 34 (FIG. (1) that is contained within a magneto housing 35 that is affixed to the cylinder block 26 in an appropriate manner.

As has been noted, the engine 14 operates on the two-stroke, crankcase compression principle. For that reason, the crankcase in which the crankshaft 19 rotates is divided into a plurality of sealed chambers 34. A suitable charge forming system including carburetors 35 having individual carburetors barrels communicate with the crankcase chambers 34 through an intake manifold 36 in which reed-type check valves 37 are provided for precluding reverse flow from the crankcase chambers 34 back through the carburetors 35.

It should be noted that the carburetors 35 form induction passages 38 which are generally straight but which are disposed at an angle to each other that is generally the same as the angle of the cylinder banks 27. As a result and as may be seen clearly in FIG. 2, this angular relationship tends to add to the width of the engine since the inlet ends of the carburetors 35 are spaced more widly apart than are the outlet ends of the induction passages 38.

A system is provided for delivering fuel to the carburetors 35 and this includes a connecting fuel conduit 39.

In accordance with this embodment of the invention, there is provided an air intake device 41 for each bank of carburetors 35. Each air intake device 41 is comprised of a generally vertically extending plenum chamber 42 that receives air from reversely facing air intake portions 43 that face the valley of the V defined by the carburetors 35 and specifically the crankcase chambers 34. As a result, any induction system sounds will be reflected back against and absorbed by the mass of the engine. Also, since the inlet portions 43 are disposed inwardly in the V between the carburetors 35, a relatively compact area will result.

Filter screens 44 are provided adjacent the inlets 43 for preventing the ingestion of foreign material. The intake devices 41 have outlet openings 45 that communicate with the inlets of the carburetors 35 for delivering air thereto.

The intake devices 41 are affixed to the carburetors 35 in a suitable manner, as by fasteners 46.

Figure 3:
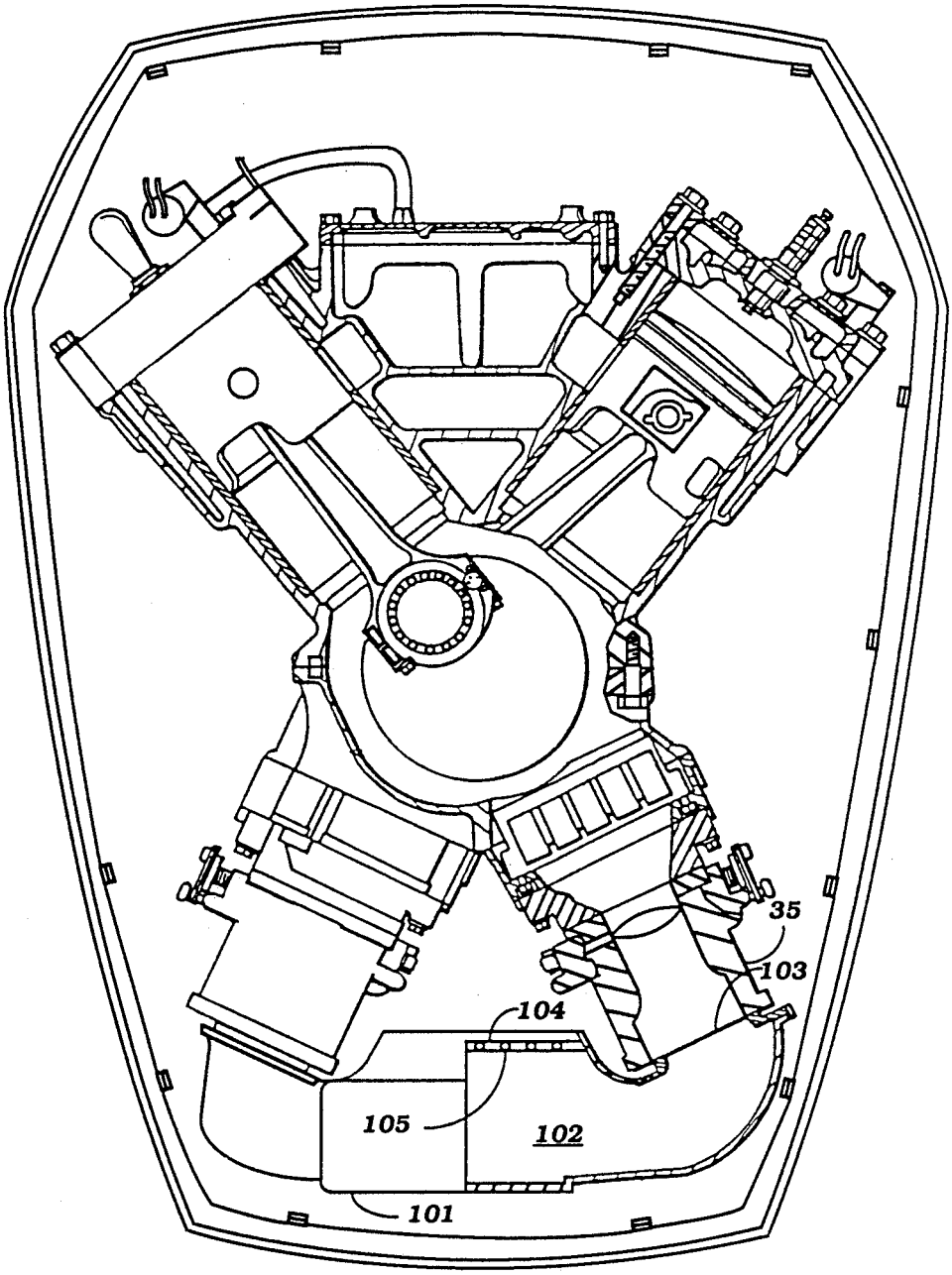
FIG. 3 is a top plan view, in part similar to FIG. 2, showing another embodiment of the invention.

In the embodiment of FIGS. 1 and 2, there has been provided a separate intake device 41 for all of the carburetor barrels of each cylinder bank. However, the invention can also be practiced in connection with an arrangement wherein a single intake device is provided for the carburetors of both cylinder banks and FIG. 3 shows such an embodiment. Because the construction of the basic engine is the same in this embodiment as in the previously described embodiment, those components which are the same have been identified by the same reference numerals and will not be described again in detail. In this embodiment, an intake device 101 defines a generally vertically extending plenum chamber 102 and has a plurality of individual outlet ends 103 that communicate with the inlet ends of each carburetor 35. The intake device is provided with one or more inlet openings 104 that face the valley of the V between the carburetors 35 for silencing and compaction purposes, as previously noted. There is also provided a screen 105 across the individual intake openings 104 to prevent the ingestion of foreign matter.

It should be readily apparent that the described embodiments are highly effective in providing a high volume air intake device for an internal combustion engine which is nevertheless compact in nature and which will insure good silencing. Although two embodiments of the invention have been illustrated and described, various changes and modifications may be made. For example, the embodiments shown in FIGS. 2 and 3 may use individual air intake devices for each carburetor barrel or pairs of carburetor barrels in each cylinder bank. In addition, although the invention has been described in conjunction with carbureted engines, it may also be employed with fuel injected engines. Various other changes and modifications may be made without departing from the spirit and scope of the invention, as defined by the appended claims.

I claim:

1. An induction system for an engine comprised of a pair of angularly disposed inductuion devices having inlet portions, and outlet ends disposed closer to each other than said inlet portions, air intake means associated with said induction devices and having outlet means communicating with said inlet portions for delivering air thereto, and air inlet means for admitting atmospheric air to said intake device means, said air inlet means being disposed between said induction devices.

2. An induction system as set forth in claim 1 wherein the induction devices are disposed at an acute angle to each other.

3. An induction system as set forth in claim 2 wherein the induction devices deliver air to different chambers of the same engine.

4. An induction system as set forth in claim 3 wherein the different chambers comprise crankcase chambers and wherein the associated engine is of the crankcase compression, two-cycle type.

5. An induction system as set forth in claim 4. wherein the induction devices comprise carburetors.

6. An induction system as set forth in claim 1 wherein the engine is comprised of pairs of angularly disposed cylinder banks and the intake devices are angularly related so as to form a generally X-shape configuration with the cylinder banks.

7. An induction system as set forth in claim 1 in combination with an outboard motor wherein the engine is supported with its output shaft rotatably journaled about a vertically extending axis and wherein the induction devices are formed at the front of the engine.

8. An outboard motor as set forth in claim 1 wherein the induction devices are disposed at an acute angle to each other.

9. An outboard motor as set forth in claim 8 wherein the induction devices deliver air to different chambers of the same engine.

10. An outboard motor as set forth in claim 9 wherein the different chambers comprise crankcase chambers and wherein the associated engine is of the crankcase compression, two-cycle type.

11. An outboard motor as set forth in claim 10 wherein the induction devices comprise carburetors.

12. An outboard motor as set forth in claim 11 wherein the engine is comprised of pairs of angularly disposed cylinder banks and the intake devices are angularly related so as to form a generally X-shape configuration with the cylinder banks.

13. An induction system as set forth in claim 1 wherein the air inlet means comprises an inlet device facing in the direction toward the outlet ends of the induction devices.

14. An induction system as set forth in claim 13 wherein the air flows through the air intake device means from the air inlet means in a re-entrance fashion to exit to the inlet portions of the induction devices.

15. An induction system as set forth in claim 7 wherein the air inlet means comprises an inlet device facing in the direction toward the outlet ends of the induction devices.

16. An induction system as set forth in claim 15 wherein the air flows through the air intake device means from the air inlet means in a re-entrance fashion to exit to the inlet portions of the induction devices.

* * * * *

UNITED STATES PATENT AND TRADEMARK OFFICE

CERTIFICATE OF CORRECTION

PATENT NO. : 4,967,704

DATED : November 6, 1990

INVENTOR(S) : Hirofumi Imaeda

It is certified that error appears in the above-identified patent and that said Letters Patent is hereby corrected as shown below:

Column 4, line 30, Claim 1, "inductuion" should be --induction--.

Column 4, line 31, Claim 1, "closer" should be --close--.

Column 4, line 49, Claim 5, after "4" delete ".".

Signed and Sealed this

Ninth Day of March, 1993

*Attest:*

STEPHEN G. KUNIN

*Attesting Officer*

*Acting Commissioner of Patents and Trademarks*